United States Patent [19]

Langenberg et al.

[11] 4,391,470

[45] Jul. 5, 1983

[54] METHOD OF, AND APPARATUS FOR, WINNING MINERAL MATERIAL

[75] Inventors: Helmut Langenberg, Lunen; Hans-Theodor Grisebach, Unna; Heinz Weinhold, Gelsenkirchen, all of Fed. Rep. of Germany

[73] Assignee: Gewerkschaft Eisenhutte Westfalia, Lunen, Fed. Rep. of Germany

[21] Appl. No.: 241,483

[22] Filed: Mar. 9, 1981

[30] Foreign Application Priority Data

Mar. 14, 1980 [DE] Fed. Rep. of Germany ..... 3009923

[51] Int. Cl.[3] ..... E21C 27/24; E21C 35/16

[52] U.S. Cl. ..... 299/11; 299/33; 299/43

[58] Field of Search ..... 299/11, 18, 32, 33, 299/34, 43

[56] References Cited

U.S. PATENT DOCUMENTS

| | | | |
|---|---|---|---|
| 2,891,778 | 6/1959 | Milik | 299/18 X |
| 3,945,680 | 3/1976 | Henrich et al. | 299/18 X |
| 3,999,804 | 12/1976 | Simpson | 299/11 |
| 4,095,845 | 6/1978 | Paurat | 299/18 |

*Primary Examiner*—Ernest R. Purser

*Attorney, Agent, or Firm*—Thompson, Birch, Gauthier & Samuels

[57] ABSTRACT

The specification discloses a method of, and apparatus for, winning mineral material from the pillars left by the bord-and-pillar mining process. An arcuate longwall face, which may be convex or concave, is formed along a row of pillars. The mineral material in the pillars is won by mechanical winning means such as a plough, the pillars in each row being won in a non-uniform manner. Some of the mineral material won from the longwall face may be used to fill the stalls left between the pillars behind the longwall face.

22 Claims, 5 Drawing Figures

METHOD OF, AND APPARATUS FOR, WINNING MINERAL MATERIAL

BACKGROUND TO THE INVENTION

This invention relates to a method of, and apparatus for, winning mineral material such as coal from the pillars left by the bord-and-pillar mining process.

The bord-and-pillar process entails driving a series of stalls into a seam, the stalls defining two sets of parallel passageways at right-angles to one another. Obviously, the process leaves a series of pillars, the pillars being effective to support the roof of the working. Originally, the stalls were won by hand, but nowadays automatic winning machines are used to win the mineral material, particularly coal. However, whichever method of winning has been used, the pillars remaining contain approximately 40% to 70% of the mineral material originally available for winning. It is, therefore, desirable to find a method suitable for winning mineral material from these pillars. Unfortunately, until now, no suitable method has been found for winning the pillars economically, whilst ensuring that the roof of the working is reliably supported during the pillar winning operation. Consequently, using known methods, only part of the pillars can be won, it being necessary to leave substantial portions of the pillars so as to support the roof of the working.

The aim of the invention is to provide a method of, and apparatus for, winning such pillars completely and economically, whilst reliably supporting the roof of the working.

SUMMARY OF THE INVENTION

The present invention provides a method of winning mineral material from the pillars left by the bord-and-pillar mining process, the method comprising the steps of forming an arcuate longwall face which extends along a plurality of pillars, and of winning mineral material from said pillars using mechanical winning means.

Using this method, a relatively large number of pillars, which are disposed side-by-side in a row, can be won simultaneously by the particularly economical long-wall system utilising highly efficient winning machines such as ploughs. The arcuate nature of the longwall face, and therefore of the longwall working, ensures that the pillars of a given row are won in a non-uniform manner. Thus, when the longwall face is advanced so that part of the face cuts into pillars of the next row, other parts of the face will still cut into pillars of the first-mentioned row. Consequently, the roof support units which are usually used to support the roof of a longwall working do not all need to be advanced at the same time. In other words, only the roof support units positioned in the regions where the face cuts into the next row of pillars need be advanced at a given stage of face advance; the remaining portions of the pillars of the first-mentioned row being sufficiently strong to support the roof of the working in their immediate vicinities. Obviously, as the face advances, the reverse situation occurs, that is to say the roof support units not previously advanced must be advanced when the associated pillars have been completely won, whereas the already-advanced roof support units need not be advanced, at this stage, because the associated pillars of the next row are sufficiently strong for adequate roof support.

Advantageously, some of the mineral material won from the longwall face is used to fill the stalls left between the pillars behind said longwall face, said some mineral material being blown into said stalls. Preferably, a binding agent is added to said some mineral material before it is used to fill said stalls. Where the mineral material being won is coal, the binding agent should have a low ash-content. In some cases, it may be advisable to comminute said some mineral material before it is used to fill said stalls. The filling of the stalls is particularly useful where the roof of the working is not very secure. Typical binding agents are cellulose materials which occur as waste in the manufacture of, for example, paper.

The method of the invention can be carried out equally well whether the face is concave or convex.

The invention also provides apparatus for winning mineral material from the pillars left by the bord-and-pillar mining process, the apparatus comprising an arcuate longwall conveyor extending along a plurality of pillars, mechanical winning means for winning mineral material from said pillars, and a roof support assembly for supporting the roof of the working.

Advantageously, the conveyor is a scraper-chain conveyor. Such a conveyor, which is constituted by a plurality of channel sections joined together end-to-end, is particularly suitable as it can easily be curved to follow the arcuate face, and is easily advanceable, in sections, by means of hydraulic advance rams.

In one preferred embodiment, a plough constitutes the mechanical winning means. Alternatively, a plurality of hewing chisels constitutes the mechanical winning means, the hewing chisels being supported by means extending substantially the entire length of the longwall face, and wherein means are provided for reciprocating the support means along the face. In this case, a network may constitute said support means, the network extending substantially the entire height of the face. This alternative winning means is particularly useful when the face is convex. Preferably, hydraulic rams are provided at each end of said support means, the hydraulic rams constituting the means for reciprocating the support means.

When the roof support assembly is constituted by a plurality of roof support units positioned side-by-side alongside the conveyor, each of the roof support units may be provided with pivotable guide arm means which engage with said support means to force said support means against the longwall face. Advantageously, each of the pivotable guide arm means is constituted by a plurality of pivotable guide arms, and each of the guide arms is a telescopic guide arm.

BRIEF DESCRIPTION OF THE DRAWINGS

The invention will now be described in greater detail, by way of example, with reference to the accompanying drawings, in which.

DESCRIPTION OF PREFERRED EMBODIMENT

Figure 1:
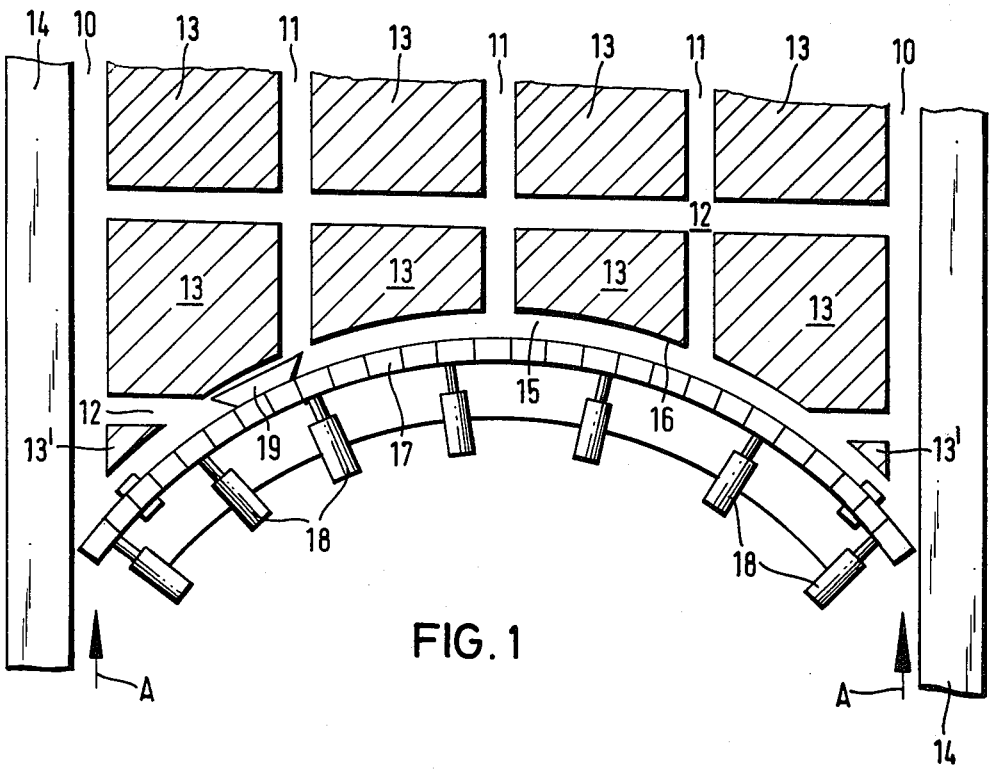
FIG. 1 is a plan view of a first form of apparatus constructed in accordance with the invention, and for winning coal from a group of pillars.

Referring to the drawings, FIGS. 1 to 4 show the pillars 13 of coal left at the end of the well-known mining method known as bord-and-pillar mining. In this mining method, stalls 11 and 12 are driven into a coal seam, the stalls 11 lying parallel to the roadways (or galleries) 10, and the stalls 12 being at right-angles thereto. The pillars 13 typically have sides of about 30 meters, whereas the stalls 11 and 12 have widths of about 5 meters. Pillars 13 of such dimensions are necessary to support the roof of the working during the excavation of the stalls 11 and 12. The roadways 10 are reinforced by, for example, brickwork walls 14.

Figure 2:
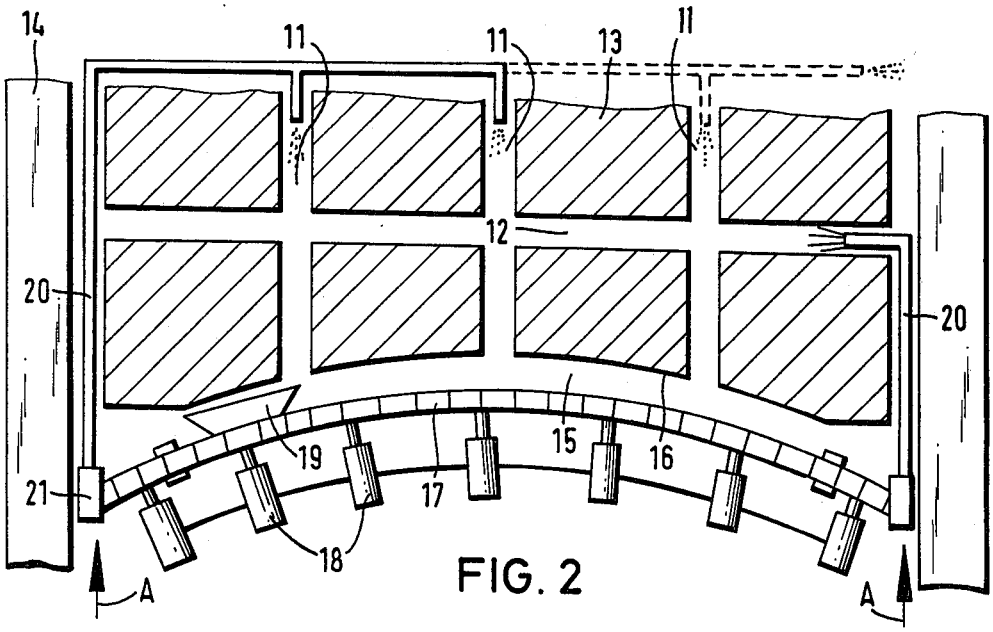
FIG. 2 is a plan view similar to that of FIG. 1, but shows the apparatus in an advanced working position, and also shows a modification to the winning apparatus.

FIGS. 1 and 2 show a first form of apparatus for winning the coal contained in the pillars 13. In this embodiment, a longwall working 15, having a longwall face 16, is established between the two roadways 10. The longwall working 15 is arcuate and convex towards the longwall face 16. Thus, as seen in plan, the longwall working 15 is off-set, in the direction A of face advance, in its middle zone. An arcuate scraper-chain conveyor 17 is provided in the longwall working 15. As is usual with scraper-chain conveyors, the conveyor 17 consists of a plurality of channel sections joined together end-to-end, and an endless scraper assembly. The channel sections are joined together so as to permit limited articulation between adjacent pairs of channel sections. Hydraulic advance rams 18 are provided for advancing the channel sections to follow up the advance of the face 16 in the direction of the arrow A. The advance rams 18 are backed by the roof support units (not shown) of a roof support assembly. The roof support units are each preferably of the type having a roof shield supported on a floor sill by means of hydraulic props, the roof shields projecting as far as possible towards the face 16 so as to provide reliable roof support right up to the face. A coal plough 19, of known construction, is reciprocably driven along the face-side of the conveyor 17 in order to win coal from the pillars 13.

It will be apparent from FIGS. 1 and 2 that, because of the arcuate form of the longwall working 15, the pillars 13 are won in a non-uniform manner. Thus, FIG. 1 shows the remnants 13′ of a first row of pillars which are being won at the same time as the next row of pillars, the remnants 13′ being located at the ends of the working 15 adjacent to the roadways 10. The two middle pillars 13 of the next row have, by this time, been approximately half won, whereas the two end pillars of this next row have had only their corner zones slightly won. Obviously, as the face 16 is advanced in the direction of the arrow A, the middle pillars 13 of each row are won before the end pillars; and that, when the middle pillars of a given row have been completely won, the end pillars of that row still have a relatively large cross-sectional area. At this stage, the roof support units in the region of the middle pillars 13 are advanced to support the roof of the working above the stall 12 behind that row of pillars; the roof in the end regions being supported by the relatively large remnants of the end pillars. When the end pillars 13 of the row are completely won, the associated roof support units are advanced to support the roof above the stall 12 behind that row of pillars; the roof in the middle region being supported by the remnants of the middle pillars of the next row, which remnants are still relatively large.

FIG. 2 shows the apparatus of FIG. 1 in an advanced position. FIG. 2 also shows a modification to the apparatus of FIG. 1, namely the provision of means for filling the stalls 11 and 12 which are positioned behind the face 16. The filling of these stalls 11 and 12 helps to prevent the collapse of the roof of the working in these regions, as well as providing a substantially continuous face 16. In order to accomplish this filling process, some of the coal won by the plough 19 is blown continuously into the stalls 11 and 12. Blast pipes 20 are provided for conveying won coal from the delivery end of the conveyor 17 into the stalls 11 and 12. If necessary, the coal is comminuted, by means of a crusher 21, prior to entry into the pipes 20. It is also recommended that a binding agent be added to the blown coal. Preferably, the binding agent is such that the ash-content of the coal is not thereby increased appreciably. It will be understood that, as the face 16 is advanced, the blown coal filling the stalls 11 and 12, is re-won by the plough 19.

Figure 3:
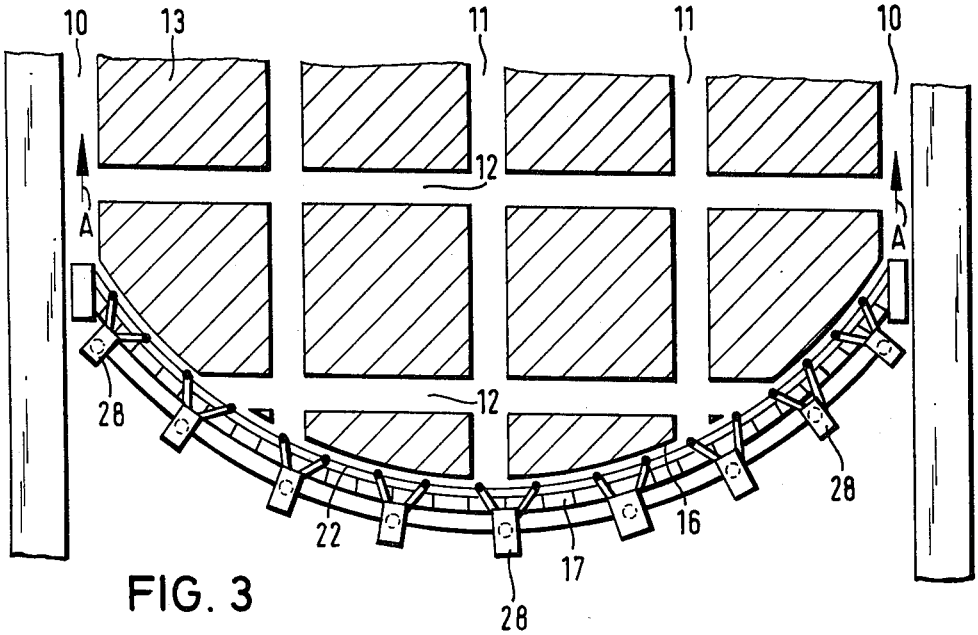
FIG. 3 is a plan view of a second form of apparatus constructed in accordance with the invention, and for winning coal from a group of pillars.
Figure 4:
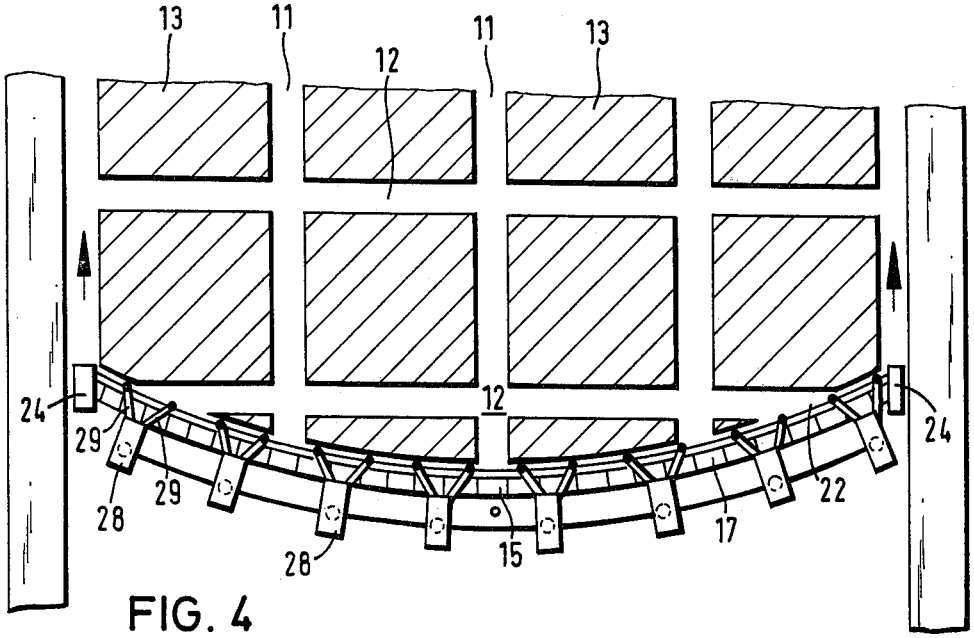
FIG. 4 is a plan view similar to that of FIG. 3, but shows the apparatus in an advanced working position.

FIGS. 3 and 4 show a second form of winning apparatus. This apparatus is very similar to that of FIG. 1, and like reference numerals have been used for like parts. The two main differences between this apparatus and that of FIGS. 1 and 2 are that the longwall working 15 is arcuate and concave towards the face 16, and that coal is won by a grid mechanism (to be described in greater detail below with reference to FIG. 5) rather than by a coal plough. Thus, as seen in plan, the longwall working 15 is off-set, in the direction A of face advance, in its two end zones. Here again, therefore, the pillars 13 are won in a non-uniform manner, so that the stalls 12 between adjacent rows of pillars can be reliably supported at all times. Although not shown in FIGS. 3 and 4, it will be appreciated that the stalls 11 and 12 could be filled with coal (or coal plus binding agent) in the same manner as that described above with reference to FIG. 2.

The grid mechanism (see FIG. 5) is constituted by a network 22 which extends substantially the entire height and length of the face 16. The network 22 supports a plurality of hewing chisels 23 or the like. The network 22 is secured to a respective support frame 24 at each of its two ends. Each support frame 24 is reciprocably mounted (for movement in the direction of the double-arrow S) on a fixed frame 26, by means of hydraulic rams 25. Thus, by suitable actuation of the rams 25 at the two ends of the network 22, the entire network is reciprocably driven along the face 16, whereby coal is won from the face by means of the chisels 23. The won coal is loaded, by way of ramp 27, onto the longwall conveyor 17.

Figure 5:
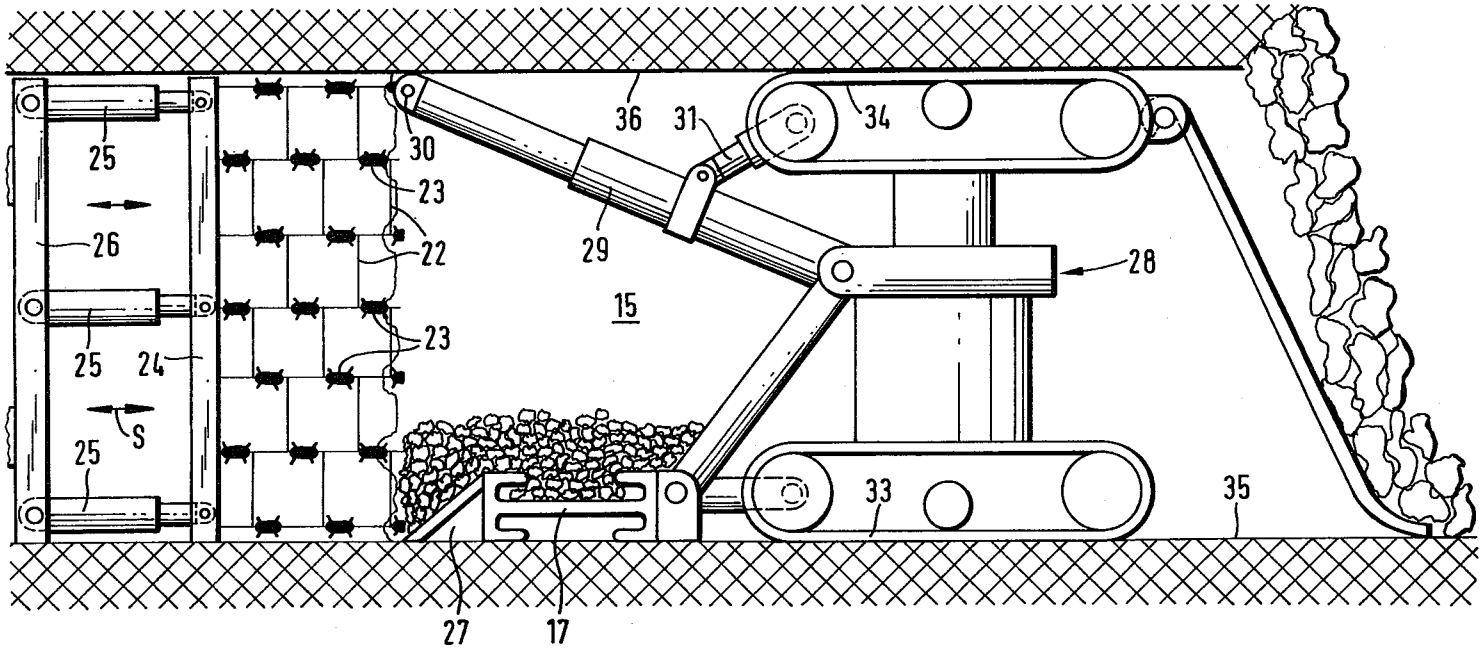
FIG. 5 is a part-sectional elevation of the apparatus of FIGS. 3 and 4.

During winning operations, the roof of the working is supported by means of advanceable roof support units 28 (these being shown schematically in FIG. 4, and one of them being shown in detail in FIG. 5). Each roof support unit 28 has a pair of telescopic guide arms 29 (only one of which can be seen in FIG. 5), whose free ends are connected, at 30, to the network 22. The guide arms 29 are capable of moving with the network 22 as the network reciprocates. The guide arms 29 are biassed outwardly, so as to force the network 22 (and hence the chisels 23) against the face 16. Similar guide arms (not shown) can also be provided at the base of each roof support unit 28, so as to force the bottom edge of the network 22 against the face 16. Hydraulic rams 31 are provided for pivoting the guide arms up and down, so as to adapt the network 22 to suit the thickness of the seam (that is to say to the height of the pillars 13).

As shown in FIG. 5, each of the roof support units 28 has a floor sill and a roof cap which are constituted by endless drive tracks 33 and 34 respectively. The tracks 33 and 34 are movable along the floor 35 and the roof 36 respectively of the working, during advance movements of the roof support units 28. The endless tracks 33 and 34 may be directly driven to advance the roof support unit 28. Alternatively, the roof support units are advanced by hydraulic advance rams, in which case the endless tracks 33 and 34 move freely during advance movements.

It is possible, particularly when using the apparatus of FIGS. 3 and 4, to dispense with the filling of the stalls 11 and 12 between the pillars 13. Moreover, other types of conveyor (such as a shuttle conveyor) can be used in place of the scraper-chain conveyor 17.

It will be apparent that, using the method described above, it is possible to win completely the pillars left by the bord-and-pillar mining process. Thus, it is possible to win mineral material such as coal which would otherwise have to be left in the ground. Moreover, the method of the invention can be used to win the pillars of old mine workings, long since abandoned, which were originally won by the bord-and-pillar process.

We claim:

1. A method of winning mineral material from pillars left between laterally spaced roadways or galleries by the bord-and-pillar mining process, the method comprising the steps of forming an arcuate longwall face which extends between the roadways across a plurality of pillars, and of winning mineral material in a non-uniform manner from said pillars using mechanical winning means.

2. A method according to claim 1, wherein some of the mineral material won from the longwall face is used to fill the stalls left between the pillars behind said longwall face.

3. A method according to claim 2, wherein said some mineral material is blown into said pillars.

4. A method according to claim 2, wherein a binding agent is added to said some mineral material before it is used to fill said stalls.

5. A method according to claim 4, wherein, when the mineral material is coal, the binding agent has a low ash-content.

6. A method according to claim 2, wherein said some mineral material is comminuted before it is used to fill said stalls.

7. A method according to claim 1, wherein a plough is used to win the mineral material.

8. A method according to claim 1, wherein, where the face is convex, a plurality of hewing chisels are used to win the mineral material, the hewing chisels being supported by a network extending substantially the entire height and length of the longwall face, and the network being movable to and fro along the face.

9. Apparatus for winning mineral material from pillars left between laterally spaced roadways or galleries by the bord-and-pillar mining process, the apparatus comprising an arcuate longwall conveyor extending between the roadways across a plurality of pillars, mechanical winning means for winning mineral material in a non-uniform manner from said pillars, and a roof support assembly for supporting the roof of the working.

10. Apparatus according to claim 9, wherein the conveyor is a scraper-chain conveyor.

11. Apparatus according to claim 9, wherein a plough constitutes the mechanical winning means, the plough being reciprocable along the conveyor.

12. Apparatus according to claim 9, wherein the longwall face is convex, and wherein a plurality of hewing chisels constitutes the mechanical winning means, the hewing chisels being supported by means extending substantially the entire length of the longwall face, and wherein means are provided for reciprocating the support means along the face.

13. Apparatus according to claim 12, wherein a network constitutes said support means.

14. Apparatus according to claim 13, wherein the network extends substantially the entire height of the face.

15. Apparatus according to claim 12, wherein hydraulic rams are provided at each end of said support means, the hydraulic rams constituting the means for reciprocating the support means.

16. Apparatus according to claim 12, wherein the roof support assembly is constituted by a plurality of roof support units positioned side-by-side alongside the conveyor.

17. Apparatus according to claim 16, wherein each of the roof support units is provided with pivotable guide arm means which engage with said support means to force said support means against the longwall face.

18. Apparatus according to claim 17, wherein each of the pivotal guide arm means is constituted by a plurality of pivotable guide arms.

19. Apparatus according to claim 18, wherein each of the guide arms is a telescopic guide arm.

20. Apparatus according to claim 9, further comprising means for filling the stalls left between the pillars behind said longwall face with some of the mineral material won from said longwall face.

21. Apparatus according to claim 20, wherein said filling means is constituted by a blower and pipes for directing blown mineral material into said stalls.

22. Apparatus according to claim 21, further comprising a crusher for comminuting said some mineral material before it enters the blower.

* * * * *